US005136126A

United States Patent [19]

Blair

[11] Patent Number: 5,136,126

[45] Date of Patent: Aug. 4, 1992

[54] TILT SWITCH

[75] Inventor: Carl D. Blair, Freeport, Ill.

[73] Assignee: Honeywell Inc., Minneapolis, Minn.

[21] Appl. No.: 720,035

[22] Filed: Jun. 24, 1991

[51] Int. Cl.[5] ..... H01H 35/02; H01H 35/14

[52] U.S. Cl. ..... 200/61.52; 200/61.45 R

[58] Field of Search ..... 200/61.52, 61.45 R, 200/DIG. 29, 61.53

[56] References Cited

U.S. PATENT DOCUMENTS

| | | | |
|---|---|---|---|
| 606,076 | 6/1898 | Ovenden | 200/DIG. 29 |
| 734,911 | 7/1903 | Mangels | 200/DIG. 29 |
| 3,108,252 | 10/1963 | Torres | 200/61.53 |
| 4,467,154 | 8/1984 | Hill . | |
| 4,618,746 | 10/1986 | Schwob . | |
| 4,686,335 | 8/1987 | Grant . | |

*Primary Examiner*—Harold Broome

*Attorney, Agent, or Firm*—William D. Lanyi

[57] ABSTRACT

A tilt switch is provided which comprises a plurality of rails which are connectable in electrical communication with circuit points of an electrical circuit. The preferred embodiment of the present invention comprises first, second and third rails which are associated in preselected pairs to define first and second tracks. In each of the two tracks, the distance between the preselected pair of rails is variable along the length of the tracks. This causes a spherical weight which is supported by a preselected one of the first and second tracks to alternatively fall out of contact with one rail and fall into contact with another rail. If first and second rails are connected to appropriate circuit points, the device can be used as a tilt switch to make and break electrical contact between appropriate components in response to changes in angular disposition of the switch.

19 Claims, 2 Drawing Sheets

TILT SWITCH

BACKGROUND OF THE INVENTION

1. Field of the Invention

The present invention is generally related to a tilt switch and, more specifically, to a switch which utilizes a moving member to bridge two conductors and provide an electrical connection therebetween under one tilting condition and to separate the conductors and deprive electrical communication between the two conductors under an alternative tilting condition.

2. Description of the Prior Art

Many different kinds of tilt switches are known to those skilled in the art. Perhaps the most well known is the mercury switch which finds world, wide use in thermostats. The well known mercury switch and other alternative tilt switches respond to changes in their attitude relative to a horizontal plane by making or breaking electrical contact between preselected conductive devices.

U.S. Pat. No. 4,686,335, which issued to Grant on Aug. 11, 1987, discloses a shock sensor switch which is sensitive to vibration. It has a pair of spaced apart parallel contacts that are housed in a switch body and a movably supported mass inside a chamber in that body. The mass is supported by conductive members in the form of a pair of bars which are secured in the mass and located between the two contacts with the center of gravity of the mass being spaced from the points of contact between the contacts and the bars so that bars are urged against the contact by a lever action as a result of the gravitational force acting on the mass.

U.S. Pat. No. 4,467,154, which issued to Hill on Aug. 21, 1984, describes a gravity switch. A molded cup-shaped dielectric member and a cup-shaped conductor member are pressed together to comprise an integral dimensionally stable sealed enclosure for a contact member which is moveable axially therein for selectively making or breaking an electrical connection between the cup-shaped conductor member and a second conductor extending axially through and sealed within the base of the cupshaped dielectric member. The enclosure has an interior cylindrical surface of optimum diameter for the axially moveable contact member which comprises a metallic ball that is also of optimum diameter for any given size switch.

U.S. Pat. No. 4,618,746, which issued to Schwob et al on Oct. 21, 1986, discloses a ball actuated position sensitive switch which operates as a multi-directional switch. It comprises a housing in which at least two electrical contacts are arranged relative to one another, a tilting member that is supported in the housing by means of a tilting part and having a control part extending in the vicinity on one of the electrical contacts. The ball is carried by a surface of the tilting member which is opposite the tilting part and has a profile in the form of a cup.

It is important, in many tilt switch applications, that the switch be sensitive to very small magnitudes of angular change of the switch relative to a reference plane, such as a horizontal plane. For example, in a household thermostat, very small angles of tilt must be responded to by a change in an electrical connection to either make or break a circuit in response to that minor change in angular relationship between the tilt switch and a reference plane.

SUMMARY OF THE INVENTION

The present invention provides a tilt switch which utilizes a moveable weight that selectively makes and breaks electrical contact between preselected pairs of conductors in response to a change in angular relationship between the switch and a horizontal plane.

In a preferred embodiment of the present invention, the tilt switch comprises first, second and third rails that are connectable in electrical communication with first, second and third circuit points. The first and third rails are associated in non-parallel association with each other to define a first track and the second and third rails are associated in nonparallel association together to define a second track. Both the first and second tracks have first and second ends. In the first track, the first and third rails are spaced farther apart at a first end than at a second end of the first track. In the second track, the second and third rails are spaced further apart at the second end than at the first end of the second track. The first and second tracks are combined together, with the common third rail, with the first end of the first track being disposed proximate the second end of the second track.

A spherical weight is disposed on a preselected one of the first and second tracks and is able to roll along the length of either the first or the second tracks. At some point along the length of each track, the rails of that track are spaced apart at a distance which is insufficiently stable to support the spherical weight on that track and, as a result, the spherical weight moves to the other track for support. In a most preferred embodiment of the present invention, the spherical weight is made of an electrically conductive material and the first and second rails are disposed in a common plane. However, it should be understood that the first and second rails are not required to be disposed in a common plane. The third rail is disposed in parallel relation with the common plane in the most preferred embodiment of the present invention, but this parallelism between the third rail and the common plane is not a necessity of the present invention. In certain circumstances and in particular applications, a tubular housing is provided and the first and second tracks are disposed in the tubular housing.

BRIEF DESCRIPTION OF THE DRAWING

The present invention will be more fully understood from a reading of the Description of the Preferred Embodiment in conjunction with the drawing, in which.

DESCRIPTION OF THE PREFERRED EMBODIMENT

Figure 1:
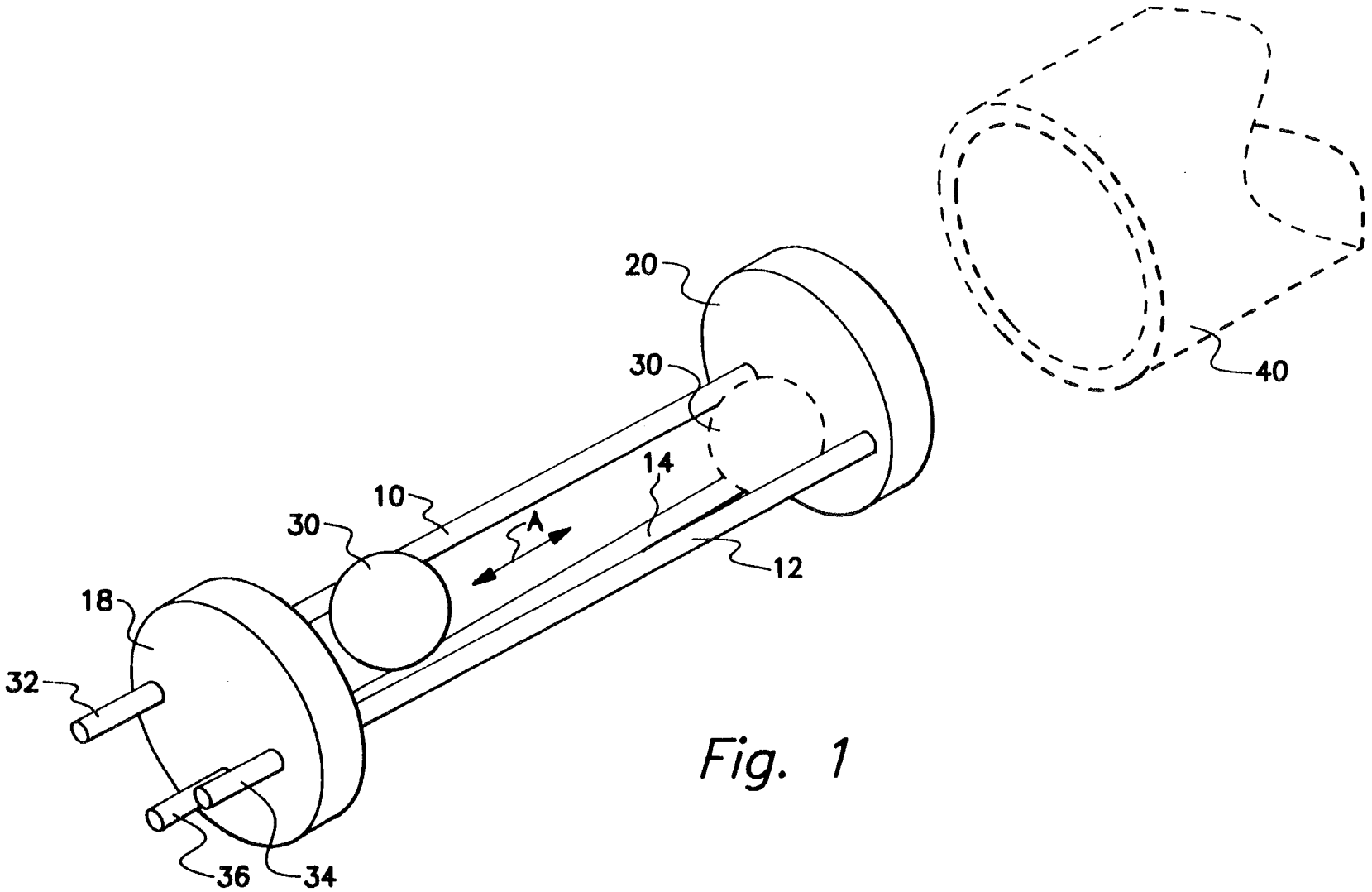
FIG. 1 illustrates a preferred embodiment of the present invention shown in perspective.

Throughout the Description of the Preferred Embodiment, like devices and components will be identified with like reference numerals.

In FIG. 1, a first rail 10 and a second rail 12 are disposed in generally parallel association with each other. It should be clearly understood that, although the preferred embodiment of the present invention will be described in terms of two generally straight rails, 10 and 12, associated parallel to each other and in the same plane, alternative embodiments of the present invention could utilize first and second rails which are not parallel to each other and which are not disposed in a common plane. In addition, it should be understood that alternative embodiments of the present invention could incorporate rails which are not straight but, instead, are curved to suit particular applications of the present invention. A third rail 14 is associated with each of the other two rails to form two tracks.

The first rail 10 and the third rail 14 are associated to form a first track. As can be seen in FIG. 1, the third rail 14 is disposed in non-parallel association with the first rail 10 to form a first track in which the first and third rails are spaced farther apart at a first end of the first track which is disposed near end piece 18 that at a second end of the first track which is disposed near end piece 20.

The second rail 12 and the third rail 14 are associated together to define a second track. A first end of the first track is disposed proximate the second end piece 20 and a second end of the second track is disposed proximate the first end piece 18. It should be understood that the first end of the second track, near end piece 20, is defined by having the second and third rail spaced further apart at that end than at the second end of the second track near end piece 18. As described above, the first track and the second track are defined by converging rails in which the convergence of the tracks are in opposite directions for the first and second tracks. A weight 30 is disposable for support on a preselected one of the first and second tracks. In FIG. 1, the spherical weight 30 defined by a solid line is supported on the first track which comprises the first 10 and third 14 rails. For purposes of illustration, the spherical weight 30 is also shown, in a different position, by a dashed line. This second representation of the spherical weight 30 is supported by the second track which comprises the second rail 12 and the third rail 14. Arrow A indicates that the spherical weight 30 can move from one end piece 18 to the other end piece 20 and back again in response to changes in the angular disposition of the present invention.

The first, second and third rails of the present invention are connectable to circuit points in an electrical circuit. Although the electrical circuit is not illustrated in FIG. 1, it should be understood that various electrical components can be disposed in electrical communication with any one or more of the rails. If the spherical weight 30 is made of an electrically conductive material, its contact between the first and second rails will connect those rails in electrical communication with each other and permit an electrical current to pass from the first rail 10 to the third rail 14 or vice versa. Similarly, when the spherical weight 30 moves to the position illustrated by the dashed line representation of the weight 30, its electrical conductivity will cause the second rail 12 and the third rail 14 to be connected in electrical communication with each other. Therefore, by moving back and forth along the first and second tracks the spherical weight 3 will alternately connect the first rail in electrical communication with the third rail and the second rail in electrical communication with the third rail. An appropriate electrical circuit connected to the ends of the rails can be constructed to respond to these alternating connections. For these purposes, the ends of the rails, which are labeled by reference numerals 32, 34 and 36 in FIG. 1, are extended beyond the first end piece 18 to facilitate electrical connection to conductors at the first, second and third connection points described above.

Also shown in FIG. 1 is a cylinder 40 that is represented by a dashed line. The portion of the cylinder 40 illustrated in FIG. 1 is intended to show that the rest of the components in FIG. 1 can be disposed in a cylinder, such as that identified by reference numeral 40, for the purpose of containing the rails and the spherical weight. Depending on the particular application intended for the present invention, the region between the end pieces, 18 and 20, can be evacuated or filled with an inert gas to minimize arcing when the spherical weight 30 changes connection with the first or second rails.

The purpose of the present invention is to provide a making and breaking of electrical conduction in response to a change in angular position of the tilt switch shown in FIG. 1. This type of switch can find application in thermostats as a replacement for the well known mercury tilt switch. However, tilt switches can also find application in many other circumstances. For example, switches which indicate that a door is opened can be provided by using the present invention. In automotive applications, tilt switches can be used to close a contact to provide electrical current to a lamp when the hood or the trunk of an automobile is opened and to break that electrical contact when the hood or trunk lid is closed.

As will be described in greater detail below, the non-parallel associations of the first and third rails and the second and third rails define tracks that have decreasing distances between their rails experience by the ball as it moves from one end to the other. For example, as the spherical weight 30 moves from end piece 18 at the first end of the first track, toward the second end of the first track, the distance under the weight between the first and third rails decreases. If the rails are appropriately positioned, the spherical weight 30 will eventually fall away from contact with the first rail 10. This occurs because of the decreasing horizontal distance between the first and third rails. Similarly, if the spherical weight 30 moves from the first end of the second track, near end piece 20, toward the second end of the second track the spherical weight 30 will fall out of contact with the second rail 12. This operation will be described in great detail below.

Figure 2:
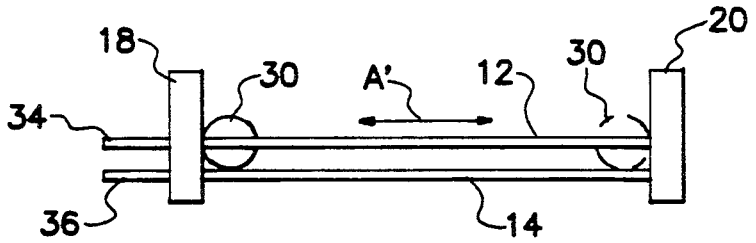
FIG. 2 shows a side view of the apparatus of FIG. 1.

FIG. 2 shows a side view of the device of FIG. 1. In the view of FIG. 2, the first rail 10 is disposed directly behind the second rail 12 and, similarly, the end portion 32 of the first rail is disposed directly behind the end portion 34 of the second rail 12. Arrow A indicates the back and forth movement that is possible for the spherical weight 30. FIG. 2 also shows the general configuration of the present invention and the relative positions and dimensions of the spherical weight 30 and the rails. It should be understood that, for ease of illustration, FIGS. 2 and 3 do not show the cylindrical housing 40. However, it should also be understood that the illustrations in FIGS. 2 and 3 would normally have a housing such as that identified by reference numeral 40 in FIG. 1.

Figure 3:
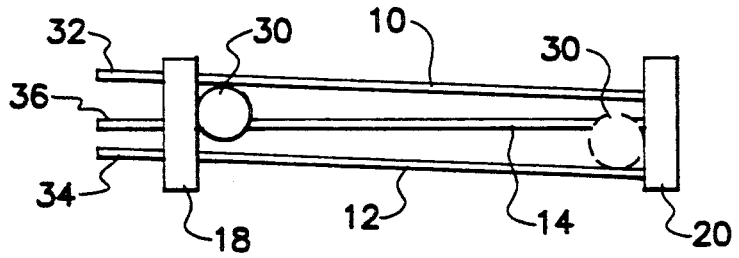
FIG. 3 shows a top view of the apparatus in FIG. 1.

FIG. 3 shows a top view of the device in FIG. 1. The spherical weight 30 shown by a solid line proximate end piece 18 is supported by the first and third rails, 10 and 14, and provides electrical connection between those rails if the spherical weight 30 is made of an electrically conductive material. When disposed at the position shown toward the left side of FIG. 3, the spherical weight 30 also provides electrical connection between the end portions, 32 and 36, of the first and third rails, respectively. When the device is tilted so that the end piece 20 is below the end piece 18, the spherical weight 30 rolls towards the right in FIG. 3 and eventually fall from support by the first and third rails and falls into support by the second and third rails as illustrated by the dashed line representation of the spherical weight 30 proximate end piece 20.

Figure 4:
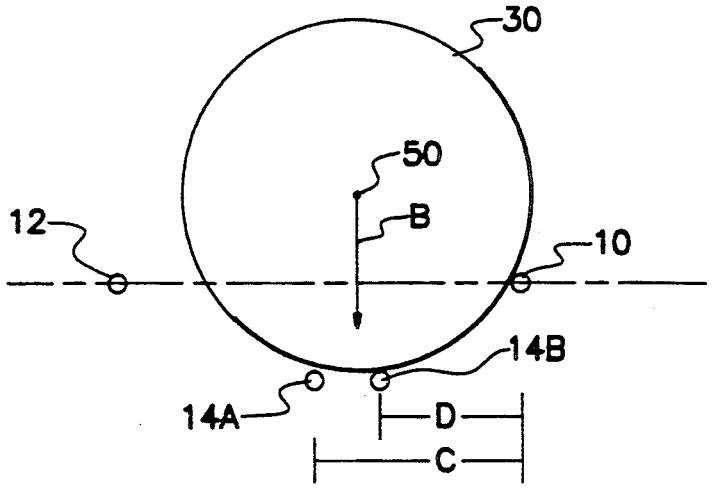
FIG. 4 shows a schematic representation of a spherical weight in association with the rails of the present invention.

FIG. 4 shows a schematic representation of the spherical weight 30 associated with a first rail 10 and a second rail 12. In FIG. 4, the third rail is shown at two positions that represent the cross sectional positions of the third rail 14 in FIGS. 1-3 at different points along the length of the first and second track. For example, the third rail identified by reference numeral 14A represents its relative position to the first and second rails that would occur toward the left side of FIG. 3. As can be seen, the center of gravity 50 of the spherical weight 30 causes the vector of the weight, identified by arrow B, to be disposed between the first rail 10 and the third rail 14A. With vector B directed downward between the first rail 10 and the third rail 14A, the position of the spherical weight 30 is stable and will remain supported by the first and third rails. As can be seen in FIG. 4, the third rail 14A is disposed at a horizontal distance from the first rail 10 which is identified by reference letter C. If dimension C diminishes to a magnitude which moves the third rail to a point which is closer to the first rail 10 than the center of gravity 50, the support of the spherical weight 30 by the first and third rails will become unstable and the spherical weight will fall out of support by the first an third rails. This situation is represented by the third rail 14B which is disposed to the right of the center of gravity vector B. This configuration would cause the center of gravity 50 to exert a force that would cause the spherical weight 30 to move toward the left while maintaining its contact with the third rail. Eventually, the spherical weight 30 will move into combined contact with the second rail 12 and the third rail 14B. This circumstance would occur as the spherical weight 30 in FIG. 3 move towards the right and the dimension between the first rail 10 and the third rail 14 under the weight 30 diminishes as a result of the nonparallelism between those rails.

The present invention provides an inexpensive tilt switch which utilizes the electrical conductivity of a weight to alternately provide electrical communication between a first and third rail and a second and third rail. When the switch apparatus is tilted, the spherical weight moves along the lengths of first and second tracks formed by the three rails. Although the present invention has been described in considerable detail and illustrated with particular specificity, it should be understood that many alternative embodiments of the present invention are possible within the scope of the present invention. For example, the first and second rails do not have to be disposed in a common plane. Furthermore, the first and second rails do not have to be parallel to each other. It should also be understood that, although the third rail is illustrated as being generally parallel to a plane in which the first and second rails are disposed, this parallelism between that plane and the third rail is not necessary in alternative embodiments of the present invention. It is also important to understand that, although the present invention has been consistently illustrated with rails which are generally straight, curved rails are also within the scope of the present invention. Curved rails could find particular use in applications in which extreme changes in angular position of the switch are expected. For example, if very small angular changes, such as 1-4 degrees, are expected, the straight rail version illustrated in the Figures would provide appropriate switching capacity and sensitivity. However, if extreme angles of tilt, such as 20-90 degrees, are expected, a switch with curved rails might be more appropriate to assure continued electrical contact between the spherical weight and the rails.

The embodiments of the invention in which an exclusive property or right is claimed, are defined as follows:

1. A tilt switch, comprising:

a first rail connectable in electrical communication with a first circuit point;

a second rail connectable in electrical communication with a second circuit point;

a third rail connectable in electrical communication with a third circuit point, said first and third rails being associated in nonparallel association with each other to define a first track, said first track having a first end and a second end, said first and third rails being spaced father apart at said first end than at said second end, said second and third rials being associated in nonparallel association with each other to define a second track, said second track having a first end and a second end, said second and third rails being spaced farther apart at said second end of said second track than at said first end of said second track, said first end of said first track being disposed proximate said second end of said second track; and a spherical weight disposed on a preselected one of said first and second tracks.

2. The switch of claim 1, wherein:

said spherical weight is made of an electrically conductive material.

3. The switch of claim 1, wherein:

said first and second rails are generally straight.

4. The switch of claim 3, wherein:

said third rail is disposed in parallel relation with a plane of said first and second rails.

5. A tilt switch, comprising:

a first rail connectable in electrical communication with a first circuit point;

a second rail connectable in electrical communication with a second circuit point, said first and second rails being disposed in generally parallel association with each other, said first and second rials being disposed in a first plane;

a third rail being disposed in nonparallel relation with each of said first and second rails, said third rail and and first rail being associated with each other to define a first track, said first track having a decreasing distance between said first and third rails from a first end of said third rial to a second end of said third rail, said third rail and said second rail being associated with each other to define a second track, said second track having a decreasing distance between said second and third rials from said second end of said third rail to said first end of said third rail, said third rail being connectable in electrical communication with a third circuit point; and a spherical weight disposable on a preselected one of said first and second tracks.

6. The switch of claim 5, wherein:

said third rail is generally parallel to said first plane.

7. The switch of claim 6, wherein:

said third rail is disposed a distance from said first plane which is less than the radius of said spherical weight.

8. The switch of claim 7, wherein:

said spherical weight is electrically conductive.

9. The switch of claim 8, wherein:

said spherical weight is shaped to be received in rolling association on a preselected one of said first and second tracks.

10. The switch of claim 9, wherein:

said first track is configured to support said spherical weight in stable relation on a first portion of said first track.

11. The switch of claim 10, wherein:

said first, second and third rails are generally straight along their entire lengths.

12. The switch of claim 11, further comprising:

a tubular housing, said first and second tracks being disposed in said tubular housing.

13. A tilt switch, comprising:

a spherical weight;

first means for supporting said spherical weight with decreasing stability from a first end of said first support means to a second end of said first supporting means, said first supporting means comprising a first pair of rails; and second means for supporting said spherical weight with decreasing stability from a first end of said second supporting means to a second end of said second supporting means, said second supporting means comprising a second pair of rails, said first and second supporting means being aligned with each other in side by side relation, said first end of said first supporting means being disposed proximate said second end of said second supporting means.

14. The switch of claim 13, wherein:

said first and second pairs of rails share a common rail.

15. The switch of claim 14, wherein:

a first rail of said first pair of rails is connected in electrical communication with a first circuit point and a first rail of said second pair of rails in connected in electrical communication with a second circuit point.

16. The switch of claim 15, wherein:

said common rail is connected in electrical communication with a third circuit point.

17. The switch of claim 16, wherein:

said spherical weight is electrically conductive.

18. The switch of claim 17, wherein:

said spherical weight is shaped to be support by said first supporting means and connect said first pair of rails in electrical communication with each other.

19. The switch of claim 18, further comprising:

a tubular housing, said first and second supporting means being disposed in said tubular housing.

* * * * *